US006880427B2

(12) United States Patent
Allen et al.

(10) Patent No.: US 6,880,427 B2
(45) Date of Patent: Apr. 19, 2005

(54) ADJUSTABLE BRAKE, CLUTCH AND ACCELERATOR PEDALS

(75) Inventors: James Allen, Elmira, MI (US); Dean William Reynolds, Boyne Falls, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 17 days.

(21) Appl. No.: 10/759,977

(22) Filed: Jan. 16, 2004

(65) Prior Publication Data

US 2004/0144194 A1 Jul. 29, 2004

Related U.S. Application Data

(62) Division of application No. 10/087,390, filed on Mar. 1, 2002, now Pat. No. 6,758,115, which is a continuation of application No. 09/564,404, filed on May 1, 2000, now Pat. No. 6,367,349.

(51) Int. Cl.[7] ..... G05G 1/14
(52) U.S. Cl. ..... 74/512
(58) Field of Search ..... 74/512–514, 560

(56) References Cited

U.S. PATENT DOCUMENTS

| | | | | |
|---|---|---|---|---|
| 3,691,868 A | 9/1972 | Smith | | 74/512 |
| 5,086,663 A | 2/1992 | Asano | | 74/512 |
| 5,632,183 A | 5/1997 | Rixon | | 74/512 |
| 5,996,438 A | 12/1999 | Elton | | 74/512 |
| 6,151,985 A | 11/2000 | Garber | | 74/512 |
| 6,178,847 B1 | 1/2001 | Willemsen | | 74/512 |
| 6,289,761 B1 | 9/2001 | Reynolds | | 74/512 |
| 6,352,007 B1 | 3/2002 | Zhang | | 74/512 |
| 2003/0056615 A1 * | 3/2003 | Oberheide et al. | | 74/512 |

* cited by examiner

*Primary Examiner*—Chong H. Kim
(74) *Attorney, Agent, or Firm*—Porter Wright; Richard M. Mescher; Dean B. Watson

(57) ABSTRACT

An adjustable control pedal for a motor vehicle includes a pivotable upper pedal arm having a slot formed therein, a link pivotable relative to the upper pedal arm, and a lower pedal arm having an upper end pivotably connected to the link and a lower end carrying a pedal. A nut is pivotally connected to the link such that the link pivots relative to the upper pedal arm upon movement of the nut along a drive screw. A pin is connected to the lower pedal arm and laterally extends into the slot such that the pin moves along the slot upon pivotal movement of the link. Also disclosed is a control pedal having a drive block or a pair of spaced apart pins located in a single slot of the upper pedal arm.

13 Claims, 13 Drawing Sheets

ADJUSTABLE BRAKE, CLUTCH AND ACCELERATOR PEDALS

CROSS-REFERENCE TO RELATED APPLICATIONS

This application is a divisional application of patent application Ser. No. 10/087,390 filed Mar. 1, 2002, now U.S. Pat. No. 6,758,115, which is a continuation application of patent application Ser. No. 09/564,404 filed May 1, 2000, now U.S. Pat. No. 6,367,349, the disclosures of which are expressly incorporated herein in their entireties by reference.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to an improved control pedal for a motor vehicle and, more particularly, to a control pedal for a motor vehicle which is selectively adjustable to desired positions.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the front seat to the most advantageous position for working the control pedals.

This adjustment method of moving the front seat along the tracks generally fills the need to accommodate drivers of various size, but it raises several concerns. First, this adjustment method still may not accommodate all drivers due to very wide differences in anatomical dimensions of drivers. Second, the position of the seat may be uncomfortable for some drivers. Therefore, it is desirable to have an additional or alternate adjustment method to accommodate drivers of various size.

Many proposals have been made to selectively adjust the position of the control pedals relative to the steering wheel and the front seat in order to accommodate drivers of various size. It would be readily apparent to those skilled in the art that these adjustable control pedals can actuate both conventional cable controls and electronic throttle controls (ETC), because the ETC is a function separate from adjustability and the ETC module would typically be positioned remote from the mechanism for adjustment of the control pedals.

U.S. Pat. Nos. 5,632,183, 5,697,260, 5,722,302, 5,819,593, 5,937,707, and 5,964,125, the disclosures of which are expressly incorporated herein in their entirety by reference, each disclose an example of an adjustable control pedal assembly. This control pedal assembly includes a hollow guide tube, a rotatable screw shaft coaxially extending within the guide tube, a nut in threaded engagement with the screw shaft and slidable within the guide tube, and a control pedal rigidly connected to the nut. The control pedal is moved forward and rearward when an electric motor rotates the screw shaft to translate the nut along the screw shaft within the guide tube. While this control pedal assembly may adequately adjust the position of the control pedal to accommodate drivers of various size, this control pedal assembly is relatively complex and expensive to produce. The relatively high cost is particularly due to the quantity of high-precision machined parts such as, for example, the guide tube and due to the quantity of welded joints.

U.S. Pat. Nos. 3,643,525 and 3,643,524, the disclosures of which are expressly incorporated herein in their entirety by reference, each disclose an example of an adjustable control pedal assembly which is much less expensive to produce. This control pedal assembly includes an upper arm having a single horizontal slot, a rotatable screw shaft attached to the upper arm and extending along the slot, a nut in threaded engagement with the screw shaft and having a pin slidable within the slot, and a control pedal rigidly connected to the nut. The control pedal is moved forward and rearward when an electric motor rotates the screw shaft to translate the nut along the screw shaft. While this control pedal assembly may adequately adjust the position of the control pedal to accommodate drivers of various size and is relatively inexpensive to produce, this control pedal is relatively unstable and can have a relatively large amount of lash. That is, components of the control pedal are subject to vibration during regular operation of the motor vehicle causing the components to rub or strike together resulting in undesirable noise.

Accordingly, there is a need in the art for an adjustable control pedal assembly which selectively adjusts the position of the pedal to accommodate drivers of various size, is relatively simple and inexpensive to produce, has a stable control pedal, has a relatively low amount of lash, and is highly reliable to operate.

SUMMARY OF THE INVENTION

The present invention provides an adjustable control pedal for a motor vehicle which overcomes at least some of the above-noted problems of the related art. According to the present invention, an adjustable control pedal includes, in combination, a pivotable upper pedal arm having a slot formed therein and a link pivotable relative to the upper pedal arm. A lower pedal arm has an upper end connected to the link and a lower end carrying a pedal. A guide is connected to the lower pedal arm and laterally extends into the slot such that the guide moves along the slot upon pivotal movement of the link.

From the foregoing disclosure and the following more detailed description of various preferred embodiments it will be apparent to those skilled in the art that the present invention provides a significant advance in the technology and art of adjustable control pedal assemblies. Particularly significant in this regard is the potential the invention affords for providing a high quality, feature-rich, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
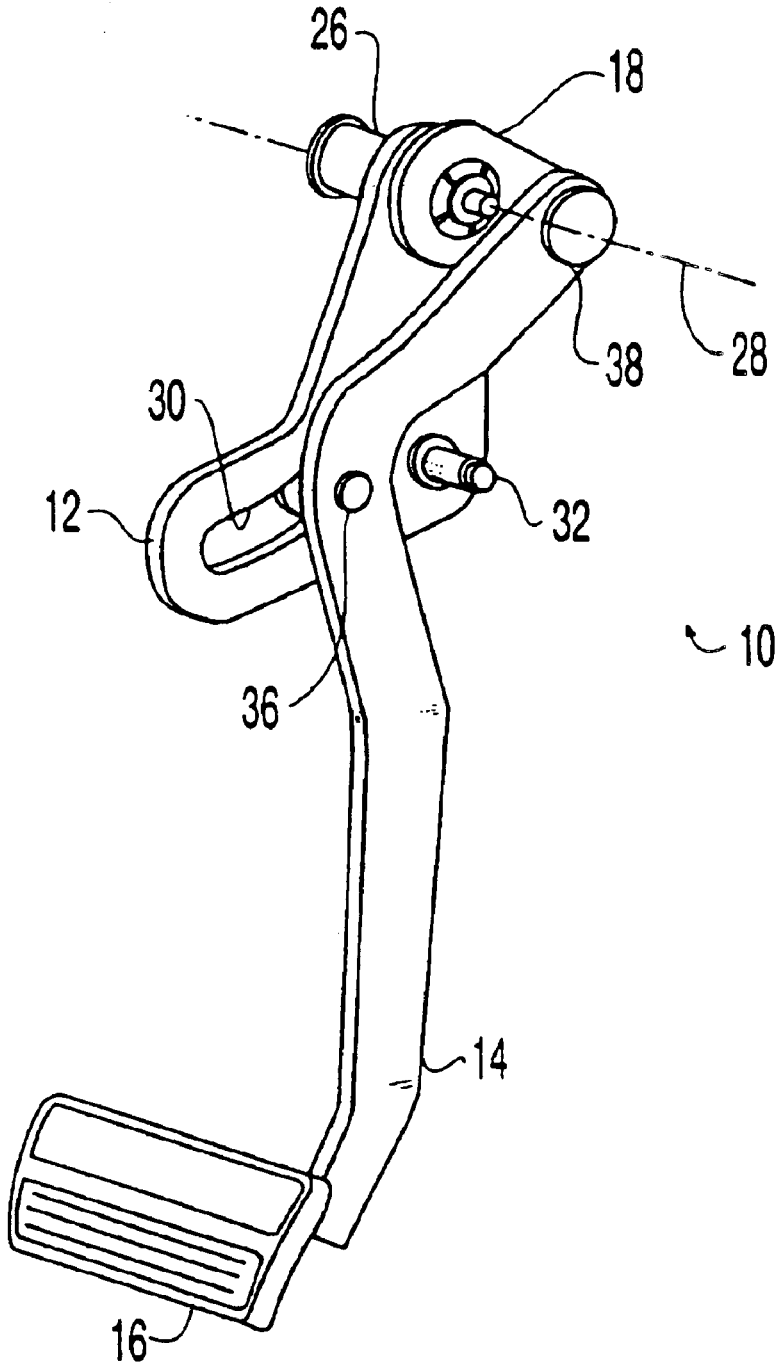
FIG. 1 is a right-rear perspective view of an adjustable control pedal according a first embodiment of the present invention wherein certain components of a drive assembly have been removed for clarity.
Figure 2:
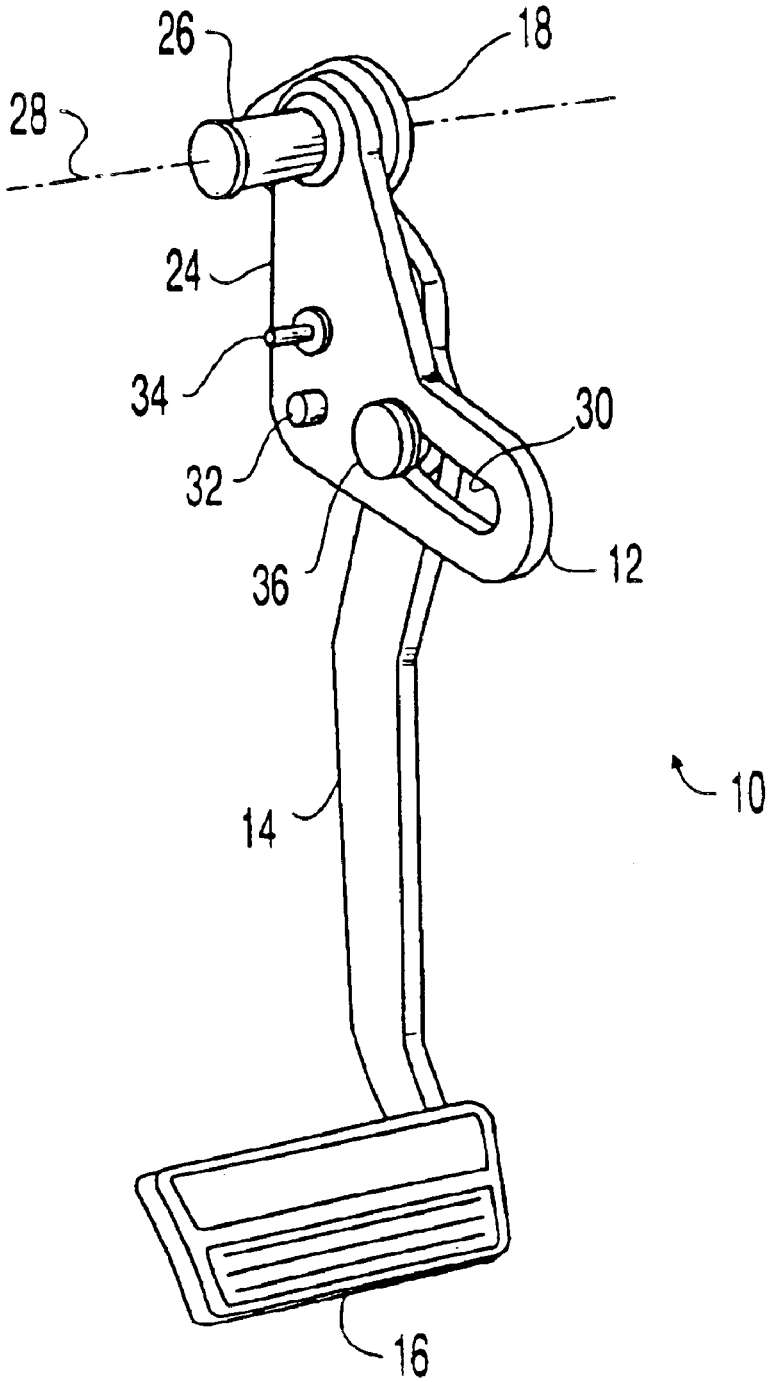
FIG. 2 is a left-rear perspective view of the adjustable control pedal of FIG. 1.
Figure 3:
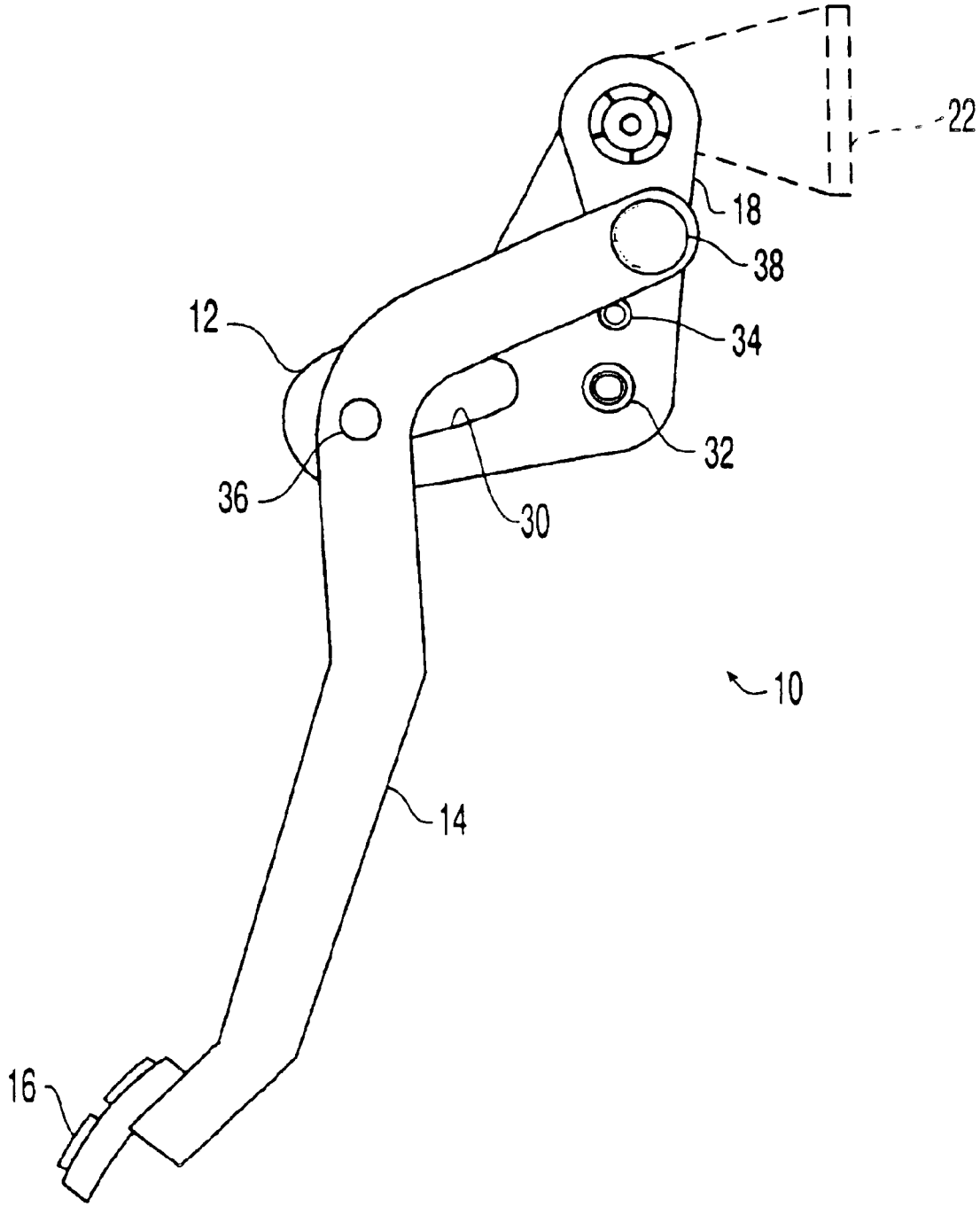
FIG. 3 is a right side elevational view of the adjustable control pedal of FIGS. 1 and 2.
Figure 4:
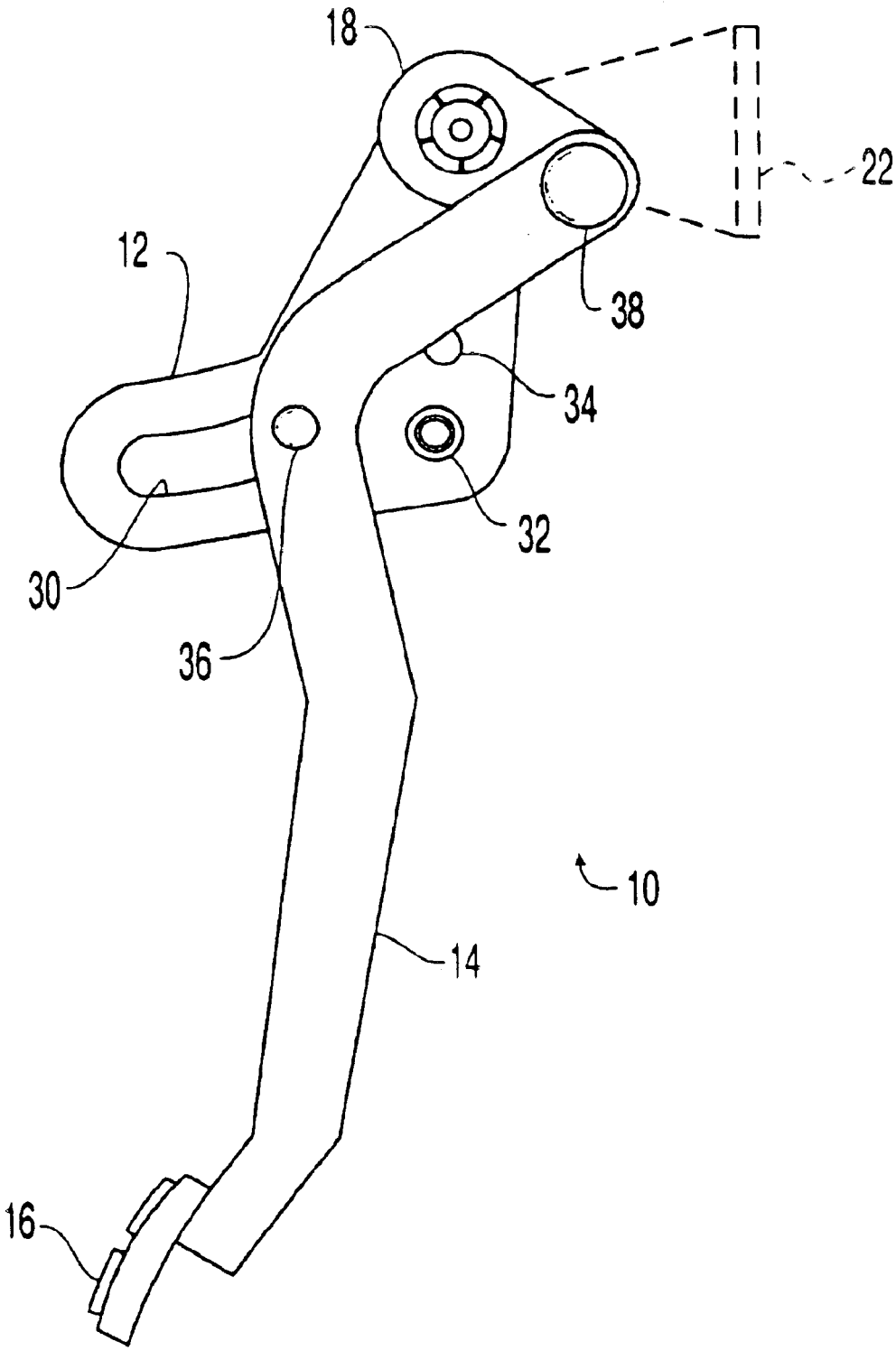
FIG. 4 is a left side elevational view of the adjustable control pedal of FIGS. 1 to 3.

It should be understood that the appended drawings are not necessarily to scale, presenting a somewhat simplified representation of various preferred features illustrative of the basic principles of the invention. The specific design features of an adjustable control pedal as disclosed herein, including, for example, specific dimensions, orientations, and shapes of the pedal arms and the slots will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction in the plane of the paper in FIG. 1 and down or downward refers to a downward direction in the plane of the paper in FIG. 1. Also in general, fore or forward refers to a direction toward the front of the motor vehicle, that is, to the right in the plane of the paper in FIG. 3 and aft or rearward refers to a direction toward the rear of the motor vehicle , that is, to the left in the plane of the paper in FIG. 3.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved adjustable control pedals disclosed herein. The following detailed discussion of various alternative and preferred embodiments will illustrate the general principles of the invention with reference to an adjustable control pedal for use with a motor vehicle. Other embodiments suitable for other applications will be apparent to those skilled in the art given the benefit of this disclosure.

Referring now to the drawings, FIGS. 1 to 4 show an adjustable control pedal 10 for a motor vehicle, such as an automobile, according to a first embodiment of the present invention which is selectively adjustable to a desired forward/rearward position by a motor vehicle operator or driver. While the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, air borne vehicles, and water borne vehicles.

The illustrated adjustable control pedal 10 is adapted as a brake pedal but it is noted that adjustable control pedal 10 can alternatively be adapted as a clutch, accelerator, or other desired pedal within the scope of the present invention. While a single adjustable control pedal 10 is illustrated, it is also noted that two control pedals 10 can be utilized together within the scope of the present invention such as, for example, control pedals 10 adapted as brake and accelerator pedals respectively. It is further noted more than two control pedals 10 can be utilized together within the scope of the present invention such as, for example, three control pedals 10 adapted as clutch, brake and accelerator pedals respectively. The control pedal 10 is selectively adjustable by the motor vehicle operator in a forward/rearward direction as described in more detail hereinafter. When more than one adjustable control pedal 10 is utilized, the control pedals 10 are preferably adjusted together simultaneously to maintain desired relationships between the control pedals 10 such as, for example, "step over", that is, the forward position of the accelerator pedal relative to the brake pedal, and "pedal angles", that is, the orientation of the contact surfaces of the pedal pads. It is noted however, that individual adjustment of a single control pedal 10 is within the scope of the present invention.

The adjustable control pedal 10 includes an upper pedal arm 12, a lower pedal arm 14 supported by the upper pedal arm 12 and carrying a pad or pedal 16 for engagement by the foot of the motor vehicle operator, a link 18 connecting the lower pedal arm 14 to the upper pedal arm 12, and a drive assembly 20 (FIGS. 7 and 8) for moving the lower pedal arm 14 relative to the upper pedal arm 12 to adjust the position of the pedal 16.

The upper pedal arm 12 is sized and shaped for pivotal attachment to a mounting bracket 22. The mounting bracket 22 is adapted to rigidly attach the adjustable control pedal 10 to a firewall or other rigid structure of the motor vehicle in a known manner. The upper pedal arm 12 is adapted for pivotal attachment to the mounting bracket 22. The illustrated upper pedal arm 12 has an opening 24 formed for cooperation with the mounting bracket 22 and an axle or pivot pin 26. With the pivot pin 26 extending through the mounting bracket 22 and the opening 26 of the link upper pedal arm 12, the upper pedal arm 12 is pivotable relative to the fixed mounting bracket 22 about a horizontally and laterally extending pivot axis 28 formed by the central axis of the pivot pin 26.

The illustrated upper pedal arm 12 is an elongate plate oriented in a vertical plane. The upper pedal arm 12 is preferably formed of a suitable metal such as steel but can alternatively be formed of a suitable plastic such as NYLON. The illustrated upper pedal arm 12 is generally "L-shaped" having a generally vertical upper portion 12*a* which generally extends downward from the pivot axis 28 and a generally horizontal lower portion 12*b* which generally extends in a rearward direction from a lower end of the upper portion 12*a*. The upper portion 12*a* is adapted for pivotal attachment of the lower pedal arm 14 to the mounting bracket 20 as described hereinabove. The illustrated opening 24 is located near the top of the upper portion 12*a* but the opening 24 can have other suitable locations on the upper pedal arm 12 within the scope of the present invention.

The lower portion 12*b* is adapted for supporting the lower pedal arm 14 and for selected fore and aft movement of the lower pedal arm 14 along the lower portion 12*b* as described in more detail hereinafter. The illustrated lower portion 12*b* has an elongate opening or slot 30 formed therein which generally extends in a forward/rearward direction along the length of the link lower portion 12*b*. The illustrated slot 30 is arcuate or curved and is rearwardly inclined, that is, the rearward end of the slot 30 is at a lower height than the forward end of the slot 30. The lower portion 12*b* is substantially planar or flat in the area of the slot 30 and the slot is open laterally through the entire thickness of the upper pedal arm 12. The slot 30 is sized and shaped for cooperation with the lower pedal arm 14 for desired forward/rearward movement of the pedal 16 relative the upper pedal arm 12 over a desired adjustment range, such as about three inches, as described in more detail hereinbelow.

The upper pedal arm 12 is operatively connected to a control device such as a clutch, brake or throttle such that pivotal movement of the upper pedal arm 12 about the pivot axis 28 operates the control device in a desired manner. The upper pedal arm 12 can be connected to the control device by, for example, a push-pull or Bowden cable for mechanical actuation or by a sensor and electrical wire or cable for electronic actuation. The illustrated upper pedal arm 12 is provided with a pin 32 for connection to the control device by a mechanical actuator. The illustrated upper pedal arm is also provided with a pin 34 for connection to a switch for indicator lights such as brake lights.

The lower pedal arm 14 is preferably formed of a suitable metal such as steel but can alternatively be formed of a suitable plastic such as NYLON. The illustrated lower pedal arm 14 is formed of an elongate plate oriented in a vertical plane substantially parallel to plane of the upper pedal arm 12. The upper end of the lower pedal arm 14 is adapted for movement relative to upper pedal arm 12 along the slot 30. The upper end of the lower pedal arm 14 is provided with guide and drive pins 34, 36 laterally and horizontally extending therefrom to cooperate with the slot 28 and the link 18 of the upper pedal arm 12 to form sliding pin/slot and pivoting connections respectively for linearly moving the lower pedal arm 14 relative to the upper pedal arm 12. The lower end of the lower pedal arm 14 is sized and shaped to carry the rearward-facing pedal 16. The pedal 16 is adapted for depression by the driver of the motor vehicle to pivot the control pedal 10 about the pivot axis 28 to obtain a desired control input to the motor vehicle through the movement of the pin 32.

Figure 5:
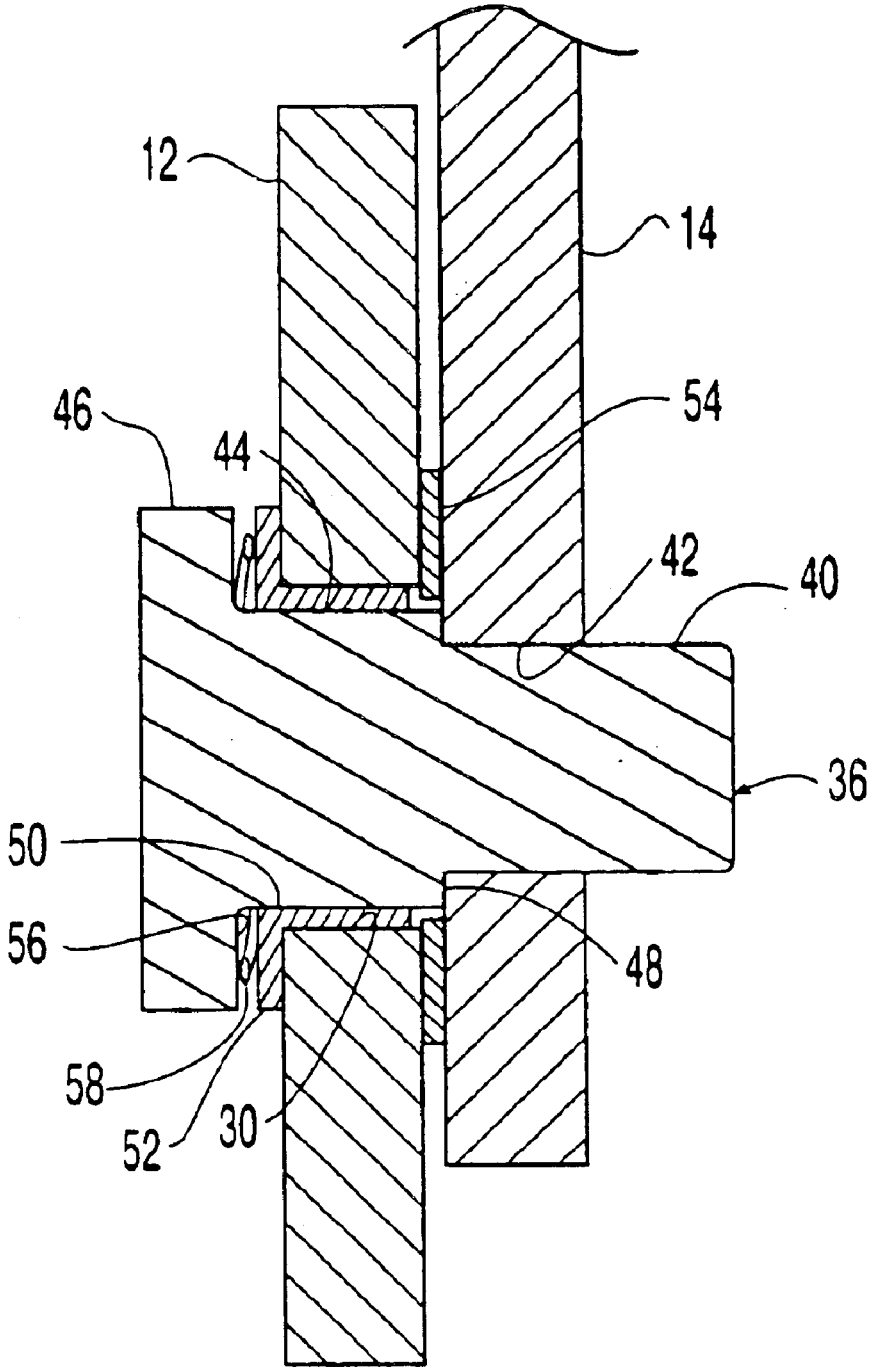
FIG. 5 is a cross-sectional view of a guide pin of the adjustable control pedal of FIGS. 1 to 4.

As best shown in FIG. 5, the illustrated guide pin 36 has a first portion 40 sized for cooperating with an opening 42 in the lower pedal arm 14, a second portion 44 sized for cooperating with the slot 30 in the upper pedal arm 12, and a flange 46 adjacent the second portion 44 and opposite the first portion 40. The first portion 40 is preferably secured to the lower pedal arm 14 such that the lower pedal arm is rotatable about the first portion 40. The guide pin 36, however, can rigidly secured to the lower pedal arm 14 by spin forming or in any suitable manner such as, for example, welding, a threaded connection with a nut, or a threaded connection with the lower pedal arm 14.

The guide pin second portion 44 is preferably sized larger than the first portion 40 to form a first abutment 48 which engages the lower pedal arm 14. The second portion 44 is also sized to cooperate with a flanged bushing 50 to extend within the slot 30 with minimal vertical movement or "play" therein. The flange 52 of the bushing 50 is sized to engage the upper pedal arm 12 adjacent the slot 30. The bushing 50 is preferably formed of a suitable plastic material but can alternatively be any suitable wear resistant and/or low friction material. Preferably, a spacer or washer 54 is located about the second portion 44 between the upper and lower pedal arms 12, 14. The washer 54 is preferably formed of a suitable plastic material but can alternatively be any suitable wear resistant and/or low friction material. The guide pin flange 46 is preferably sized larger than the guide pin second portion 44 and the slot 30 to form a second abutment 56 which faces the lateral side of the upper pedal arm 12. The length of the second portion 44 is preferably sized to permit limited lateral movement of the upper pedal arm 12 relative to the lower pedal arm 14 between the lower pedal arm 14 and the guide pin flange 46 so that there is "lateral play" between the upper and lower pedal arms 12, 14.

A spring member 58 is provided between the guide pin flange 46 and the bushing flange 52 to resiliently bias the upper pedal arm 12 and the washer 54 against the lower pedal arm 14 and to "take-up the lateral play" but allow resilient side to side movement. The spring member 58 is preferably a spring washer such as a wave washer or a Belleville washer but can alternatively be any suitable spring member such as, for example, a leaf spring.

Figure 6:
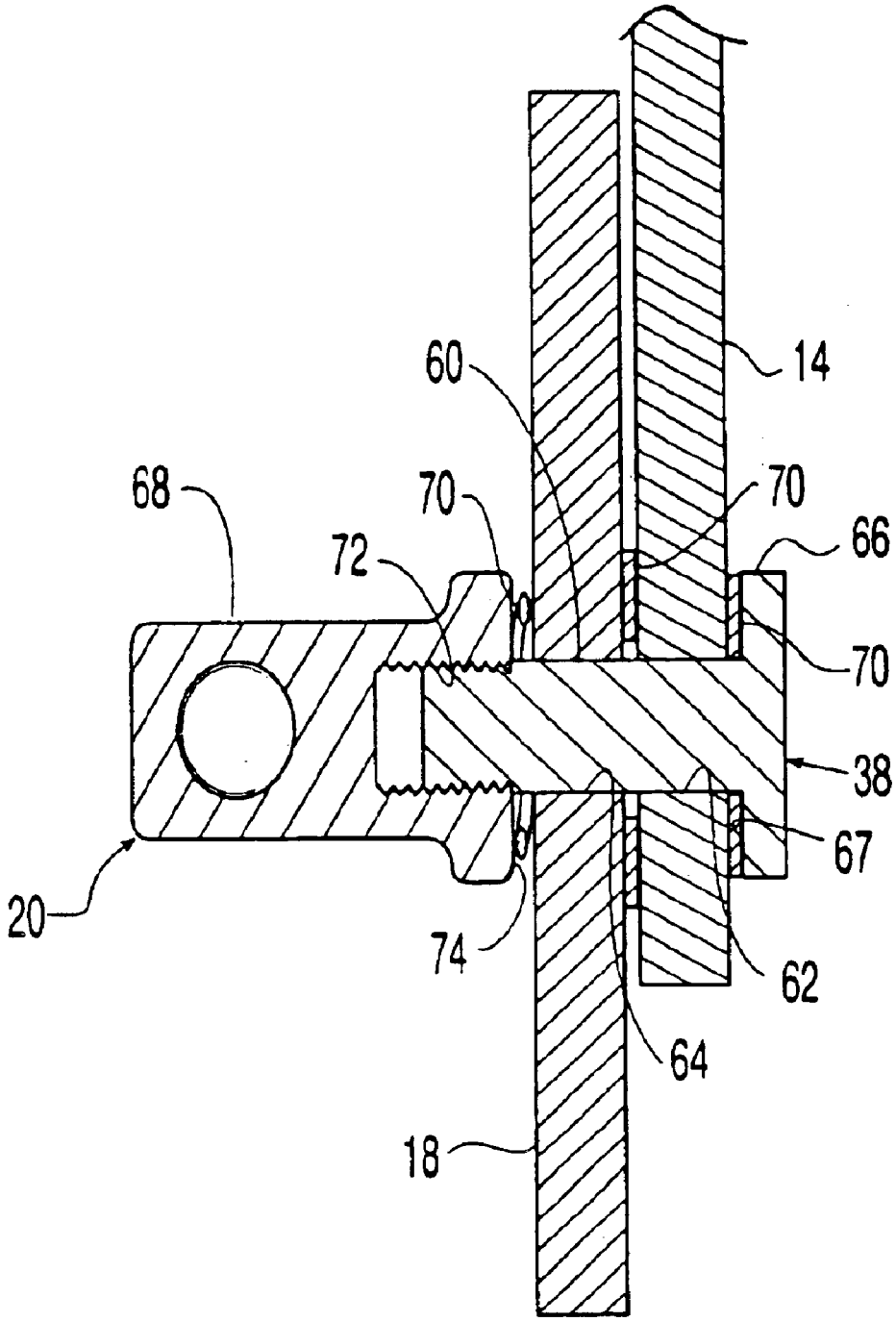
FIG. 6 is a cross-sectional view of a drive pin of the adjustable control pedal of FIGS. 1 to 4;.

As best shown in FIG. 6, the illustrated drive pin 38 has a main portion 60 sized and shaped for cooperating with an opening 62 in the lower pedal arm 14 and an opening in the link 18 and a flange 66 sized and shaped to engage the upper pedal arm 14 such that the lower pedal arm 14 and the link are pivotally connected about a generally horizontal and laterally extending pivot axis defined by the central longitudinal axis of the drive pin 38. The flange forms an abutment 67 facing the outer lateral side of the lower pedal arm 14. An end portion of the drive pin is sized and shaped for cooperation with a drive nut 68 of the drive assembly 20. Preferably, spacers or washers 70 are located about the drive pin 38 between the drive pin flange 66 and the lower pedal arm 14, between the lower pedal arm 14 and the link 18, and between the link 18 and the drive nut 68. The washers 76 are preferably formed of a suitable plastic material but can alternatively be any suitable wear resistant and/or low friction material. The end portion of the drive pin 38 is adapted to cooperate with the drive nut 68 for a rigid connection therebetween. The illustrated drive pin 38 is provided with threads which cooperate with a threaded bore 72 within the drive nut 68. The drive nut 68 is sized larger than the guide pin main portion 60 to form an abutment 74 which faces the outer lateral side of the link 18. The abutments 67, 74 cooperate to retain the lower pedal arm 14 and the link 18 on the drive pin 38. It is noted that the drive pin 38 can have many other suitable forms to pivotally connect the lower pedal arm 14 and the link 18 within the scope of the present invention.

As best shown in FIGS. 1 to 6, the link 18 is preferably formed of a suitable metal such as steel but can alternatively be formed of a suitable plastic such as NYLON. The illustrated link 18 is formed of an elongate plate oriented in a vertical plane substantially parallel to plane of the upper and lower pedal arms 12, 13. The upper end of the lower pedal arm 14 is adapted for pivotable movement relative to upper pedal arm 12. The illustrated link is pivotable about the pivot pin 26 and its central axis 28 The upper end of the link 18 63 is provided with an opening 75 sized and shaped for pivotable attachment of the link 18 to the pivot pin 26. The lower end of the link 18 is provided with the opening 64 sized and shaped to cooperate with the drive pin 38 as described hereinabove.

Figure 7:
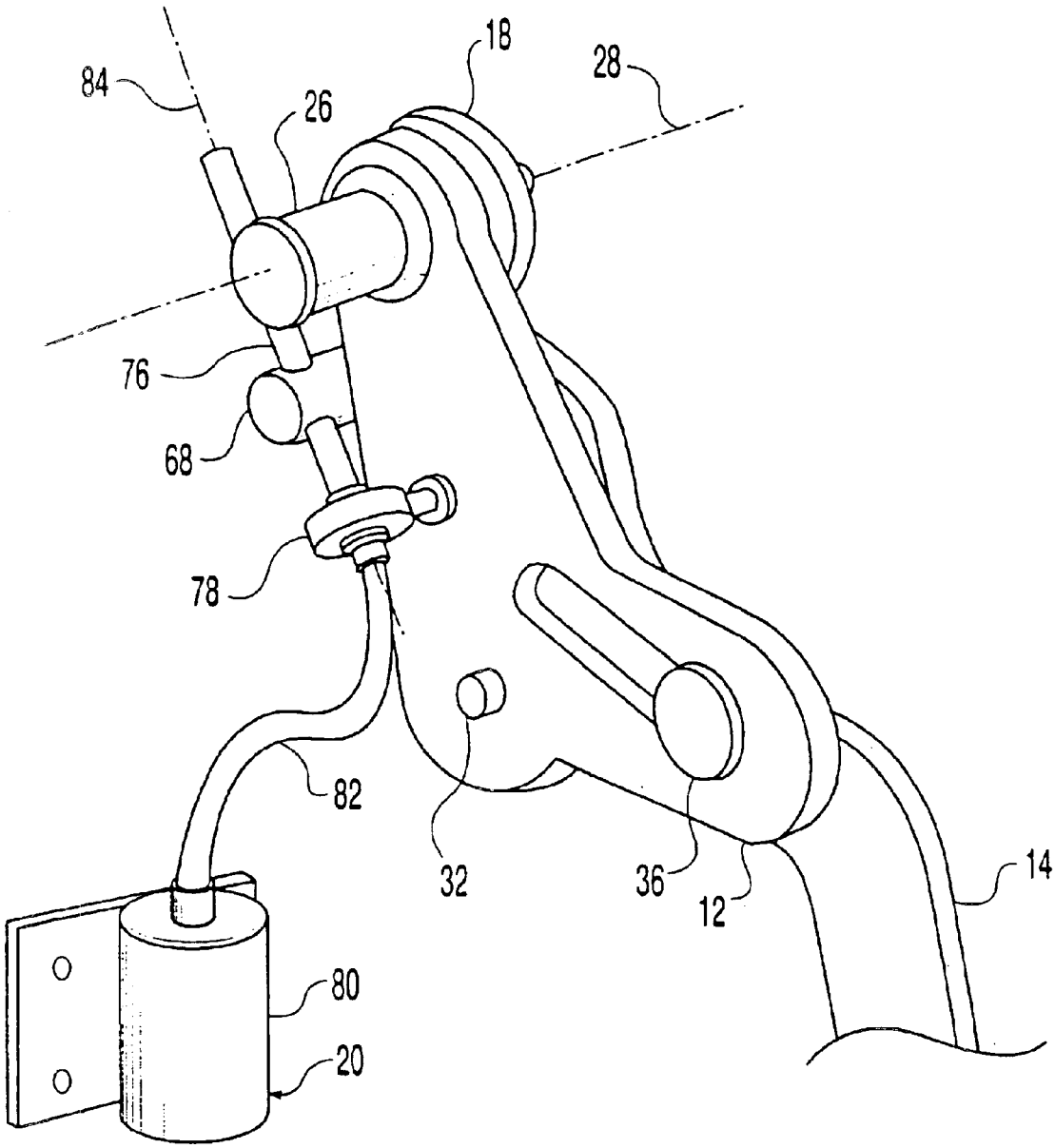
FIG. 7 is an enlarged, fragmented right-rear perspective view of a variation of the adjustable control pedal of FIGS. 1 to 4.
Figure 8:
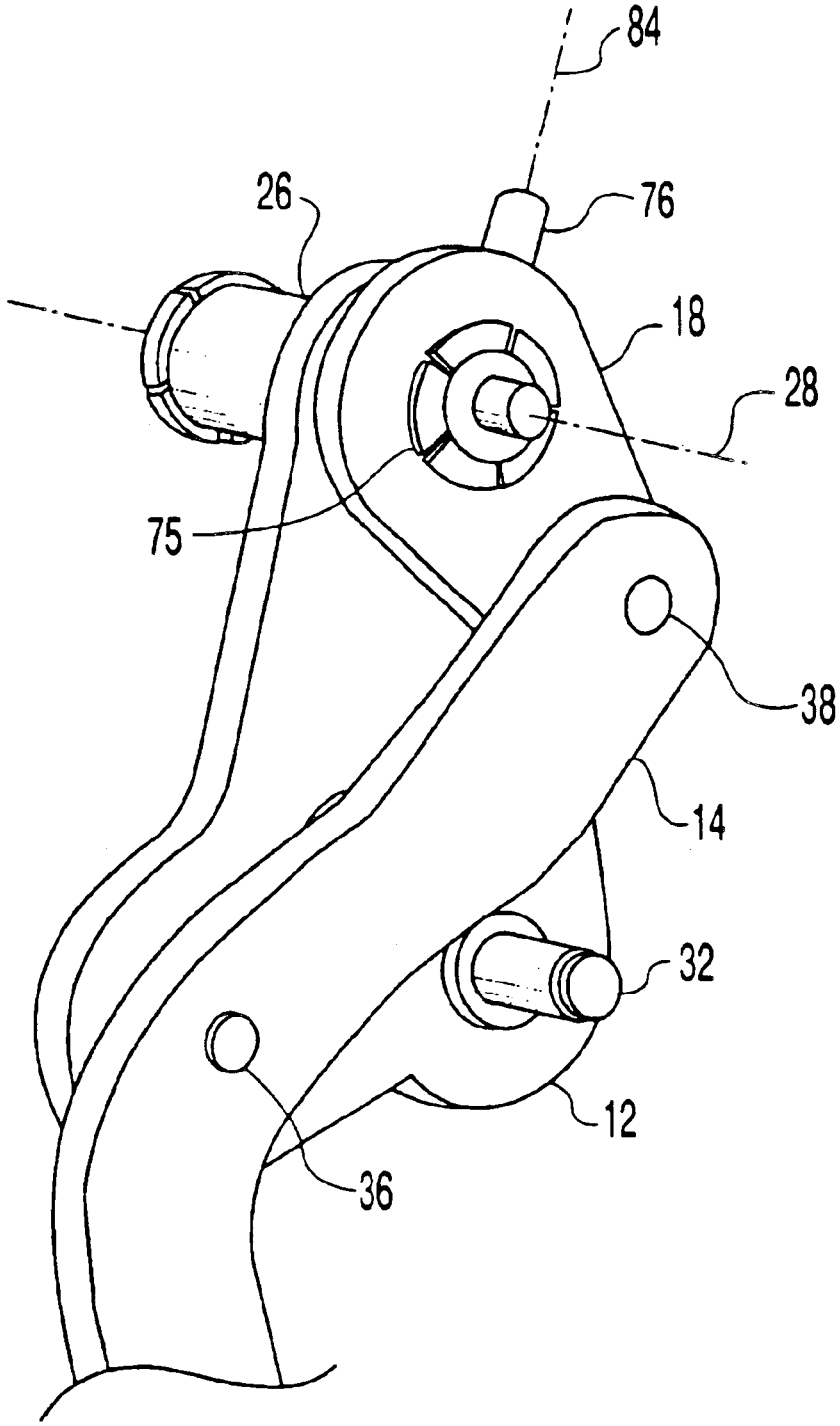
FIG. 8 is a left-rear perspective view of the adjustable control pedal of FIG. 7.

As best shown in FIGS. 7 and 8, the drive assembly 20 includes a screw shaft or drive screw 76, a drive screw attachment or housing 78 for securing the drive assembly 20 to the upper pedal arm 12, the drive nut 68 adapted for movement along the drive screw 76 in response to rotation of the drive screw 76, an electric motor 80 for rotating the drive screw 76, and a drive cable 82 for connecting the motor 80 to the drive screw 76 and transmitting rotation motion thereto.

The drive screw 76 is an elongate shaft having a threaded portion adapted for cooperation with the drive nut 68. The drive screw 76 is preferably formed of a metal such as, for example, steel but can be alternately formed of a plastic resin such as, for example, NYLON. The rearward and downward end of the drive screw 76 is journaled by the drive screw housing 78 for rotation of the drive screw 76 by the motor 80. The illustrated drive screw 76 forwardly and upwardly extends from the drive screw housing in a cantilevered fashion so that it extends forward of the upper pedal arm 12. Mounted in this manner, the drive screw 76 is inclined so that it is substantially vertical. The drive screw 76 is preferably connected to the drive screw housing 78 with a self-aligning or freely pivoting joint, that is, a joint which freely permits pivoting of the drive screw 76 relative to the drive screw housing 78 and the upper pedal arm 12 about at least axes perpendicular to the drive screw rotational axis 84. The self-aligning joint automatically corrects misalignment of the drive screw 76 and/or the drive nut 68. The self-aligning joint also allows nonlinear travel of the drive nut 68 upon pivoting of the link 18. The self aligning joint can be, for example, a ball/socket type joint.

The drive screw housing 78 is sized and shaped for supporting the forward end of the drive screw 84 and attaching the drive screw 76 to the upper pedal arm 12. The drive screw housing 78 is preferably molded of a suitable plastic material such as, for example, NYLON but can alternatively be formed of metal such as steel. The illustrated drive-screw housing 78 is secured to the upper pedal arm 12 with a snap-fit connection. It is noted, however, that the drive screw housing 78 can be unitary with the upper pedal arm 12 or secured to the upper pedal arm 12 in other suitable manners such as, for example, mechanical fasteners.

The drive nut 68 is adapted for axial movement along the drive screw 84 in response to rotation of the drive screw 84. The drive nut 68 is preferably molded of a suitable plastic material such as, for example, NYLON but can alternatively be formed of metal such as, for example steel. The drive nut 68 is secured to the drive pin 38 as described hereinabove. The drive pin 36 can be alternatively connected to the drive nut 68 with a self-aligning or freely pivoting joint, that is, a joint which freely permits pivoting of the drive nut 68 relative to the drive pin 36 about at least axes perpendicular to the rotational axis 92 of the drive screw 84. The self-aligning joint automatically corrects misalignment of the drive nut 68 and/or drive screw 84. The self aligning joint can be, for example, a ball/socket type joint.

The electric motor 80 can be of any suitable type and can be secured to the firewall or other suitable location such as, for example, the mounting bracket 22. The drive cable 82 is preferably a flexible push-pull cable and connects the motor 80 and the rearward or lower end of the drive screw 76 so that rotation of the motor 80 rotates the drive screw 76. It is noted that the drive screw 76 and the motor 80 can be alternatively connected with a rigid connection. An input end of the drive cable 82 is connected to an output shaft of the motor 80 and an output end of the drive cable 82 is connected to an end of the drive screw 76. It is noted that suitable gearing is provided between the motor 80 and the drive screw 76 as necessary depending on the requirements of the control pedal 10. It is also noted that the fixed portion or sheath of the drive cable 82 is rigidly secured to the forward end of the drive screw housing 78 and a rotating portion of the cable 82 is operatively connected to the forward end of the drive screw 76 to rotate the drive screw 76 therewith. The drive assembly 20 can also includes a cable support. The cable support enables a drive cable for another control pedal to be connected to the forward or upper end of the drive screw 76. Connecting or chaining the drive screws 76 with the electric motor 80 in series enables a single drive motor 80 to be utilized to operate multiple adjustable control pedals 10. See U.S. patent application Ser. No. 09/492,238, the disclosure of which is expressly incorporated herein in its entirety by reference, for a more detailed description of a suitable drive screw, housing, drive nut, and/or cable support.

Preferably, a controller including processing means and memory means are adapted to control operation of the motor. The controller can be a dedicated controller, the motor vehicle control unit, or a controller of another system of the motor vehicle such as, for example, a keyless entry system or a powered seat system. See U.S. patent application Ser. No. 09/492,636, the disclosure of which is expressly incorporated herein in its entirety by reference, for a more detailed description of a suitable control system having a controller.

To adjust the control pedal 10, the driver engages a control switch which activates rotation of the motor 80 in the desired direction. Rotation of the motor 80 rotates the drive screw 76 through the drive cable 82 and causes the drive nut 68 to axially move along the drive screw 76 in the desired direction. The drive nut 68 moves along the drive screw 76 because the drive nut 68 is held against rotation with the drive screw 76 by the drive pin 38. As the drive nut 68 axially moves along the drive screw 76, the drive pin 38 pivots the link 18 about its pivot axis 28 because the drive pin 38 is secured to the link 18. It is noted that binding of the drive nut 68 along the drive screw 76 is minimized if a self-aligning joint is provided, between the drive screw 76 and the drive screw housing 78 and/or the drive nut 68 and the drive pin 38, to automatically align the components so that the drive nut 68 can smoothly travel along the drive screw 76. As the drive pin 38 pivots the link 18, the lower pedal arm 14 is moved therewith to adjust the forward/rearward position of the pedal 16. As the lower pedal arm moves 14, the guide pin 36 slides along the slot 30. With such movement, the pedal 16 travels in a substantially linear and horizontal path, that is, the pedal 16 moves in a forward/rearward direction and generally remains at the same height relative to the fixed mounting bracket 22 and the upper pedal arm 12 which does not move relative the mounting bracket 22 during adjustment of the pedal 16. It is noted that the pedal 16 rotates as the lower pedal arm 14 moves so that the orientation of the pedal 16 slightly changes. As the position of the pedal 16 is adjusted by rotating the drive screw 76, the upper pedal arm 12 remains in fixed position relative to the mounting bracket 22. It can be seen from the above description that activation of the motor 80 changes the position of the lower pedal arm 14 relative to the upper pedal arm 12 but not the position of the upper pedal arm 12 relative to the mounting bracket 22 and therefore does not affect the connection of the upper pedal arm 12 to the control device of the motor vehicle through the pin 32.

It is noted that FIGS. 7 and 8 illustrates a variation of the control pedal wherein the slot 30 is inclined at a steeper angle. The orientation of the pedal 16 may change to a larger degree as it moves along its substantially linear horizontal path. It should be appreciated, however, that the package size of the control pedal 10 can be optimized for a particular motor vehicle. Particularly, the length of the upper pedal arm 12 in the forward/rearward direction can be significantly reduced. This is particularly advantageous in compact or midsize motor vehicles having power steering because the available space for the control pedal 10 below the steering column is limited.

Figure 9:
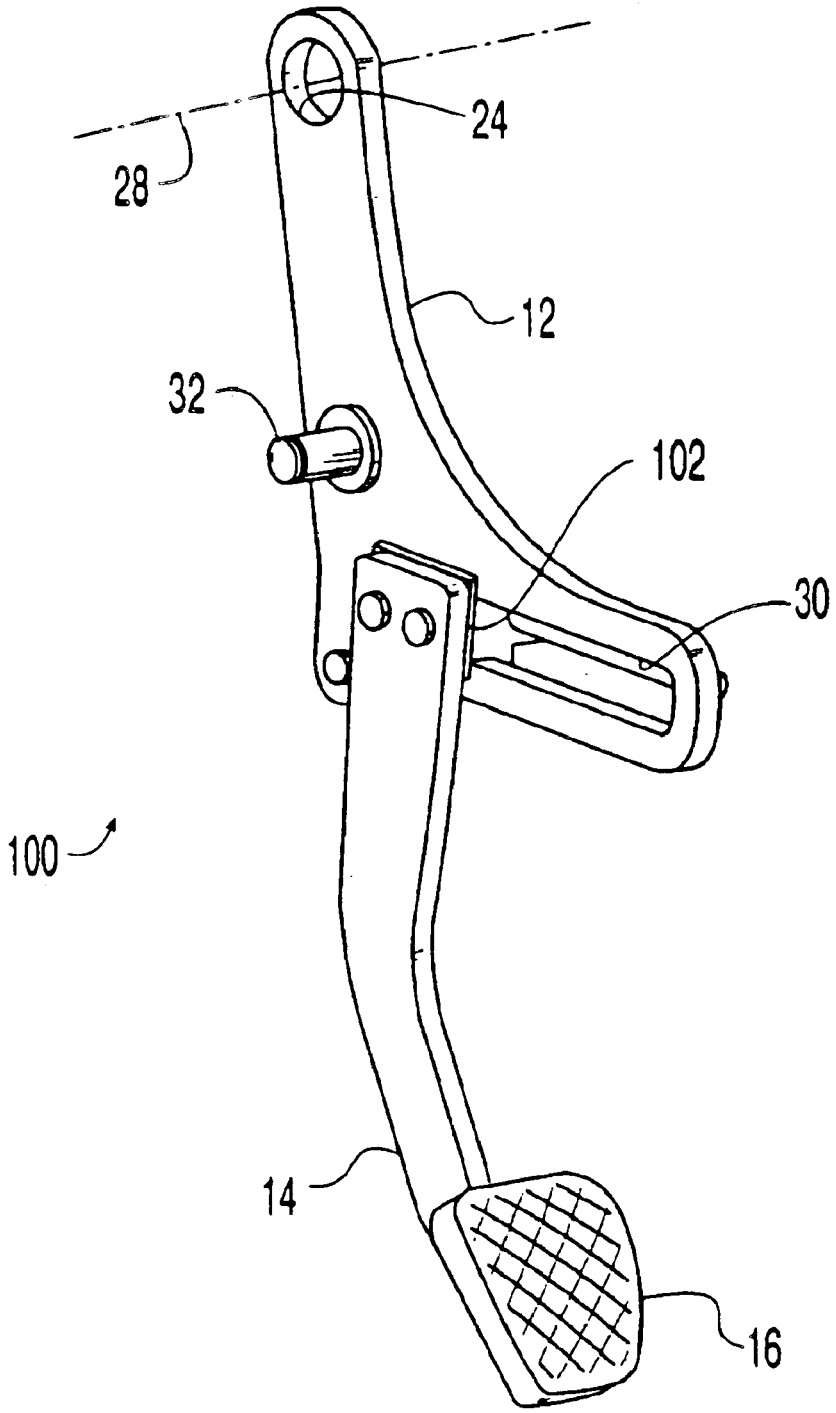
FIG. 9 is a left-rear perspective view of an adjustable control pedal according a second embodiment of the present invention wherein certain have been removed for clarity.
Figure 10:
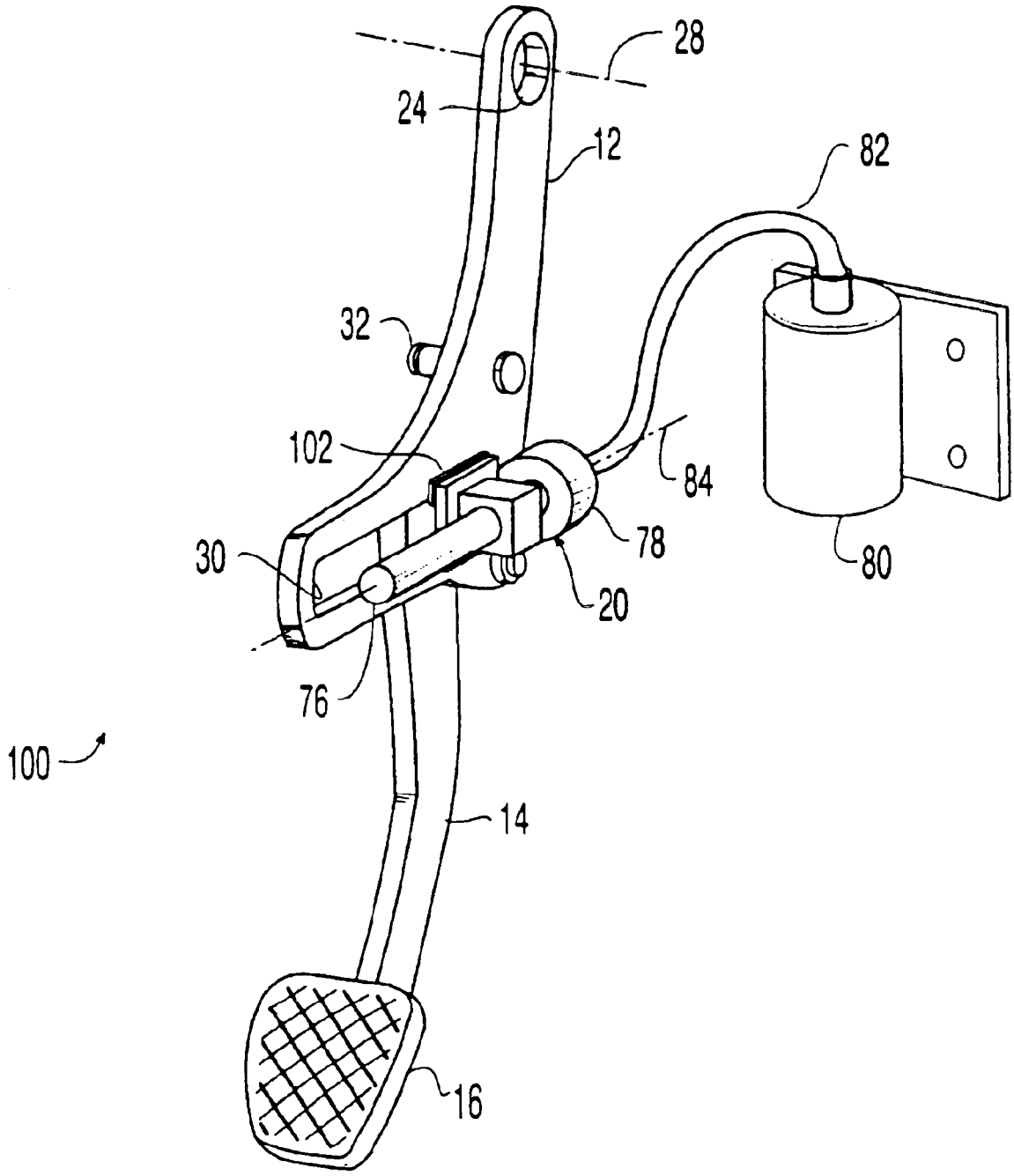
FIG. 10 is a right-rear perspective view of the adjustable control pedal of FIG. 9.

FIGS. 9 and 10 illustrate a control pedal assembly 100 for a motor vehicle according to a second embodiment of the present invention wherein like reference numbers are used for like structure. The control pedal 100 according to the second embodiment is substantially similar to the first embodiment described hereinabove with reference to FIGS. 1-8, except that the link 18 is removed and the guide and drive pins 36, 38 are replaced with a drive block 102.

Figure 11:
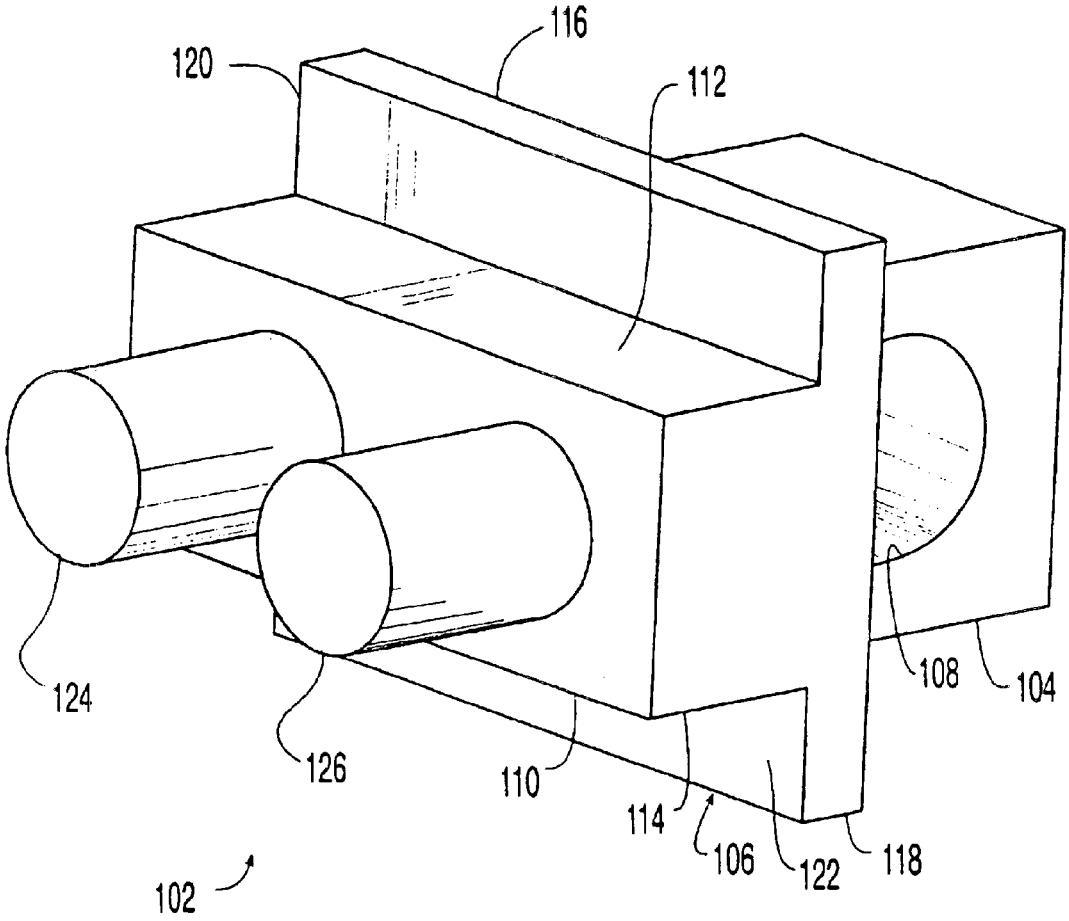
FIG. 11 is an enlarged perspective view of a drive block of the control pedal of FIGS. 9 and 10.

As shown in FIG. 11, the drive block 102 has a drive nut portion 104 for cooperating with the drive screw 76 and a guide portion 106 for cooperating with the slot 30. The drive block 102 is preferably formed of a plastic resin such as, for example, NYLON, but can alternatively be formed of a suitable metal such as, for example steel. It is noted that while the drive nut and guide portions 104, 106 of the illustrated drive block 102 are integrally formed as one piece, they can be formed as separate pieces which are suitably secured together. The drive nut portion 104 of the drive block 102 includes a threaded bore 108 sized and shaped to cooperate with the drive screw 76 such that the drive block 102 axially moves along the drive screw 76 upon rotation of the drive screw 76 when the drive block 102 is held against rotation.

The guide portion 106 has a rectangle-shaped main body 110 defining opposed upper and lower surfaces 112, 114. The body 110 is sized and shaped to be closely received within the slot 30 with the upper and lower surfaces 112, 114 engaging the upper and lower edges of the slot 30 respectively to limit vertical lash. The lateral side of the body 110 adjacent the drive nut portion 104 is provided with upper and lower flanges 116, 118 forming laterally facing abutments 120, 122. The abutments 120, 122 are sized and shaped to engage the side of the upper pedal arm 12 adjacent the slot 30 to limit lateral lash. The body 110 is also provided with a pair of spaced apart pins 124, 126 laterally extending from the side of the body 110 opposite the flanges 116, 118. The pins 124, 126 are sized and shaped to connect the drive block 102 to the upper end of the lower pedal arm 14. The length of the drive block 102 is optimally sized to provide stability for the lower pedal arm 14 and to reduce lash and/or lost motion.

To adjust the control pedal 10 (best seen in FIGS. 9 and 10), the driver engages a control switch which activates rotation of the motor 80 in the desired direction. Operation of the motor 80 rotates the drive screw 76 through the drive cable 82 and causes the drive block 102 to axially move along the drive screw 76 in the desired direction. The drive block 102 moves along the drive screw 76 because the drive block 102 is held against rotation with the drive screw 76 by the upper pedal arm 12. As the drive nut portion 104 of the drive block 102 axially moves along the drive screw 76, the guide portion 106 of the drive block 102 linearly moves along the slot 30. It is noted that binding of the drive nut 68 along the drive screw 76 is minimized if a self-aligning joint is provided, between the drive screw 76 and the drive screw housing 78 and/or the drive nut 68 and the drive pin 38, to automatically align the components so that the drive nut 68 can smoothly travel along the drive screw 76. The guide portion of the drive block 102 slides along the slot 30 and linearly moves the lower pedal arm 14 in the fore/aft direction which is secured thereto. With such movement, the pedal 16 travels in a substantially linear and horizontal path, that is, the pedal 16 moves in a forward/rearward direction and generally remains at the same height relative to the fixed mounting bracket 22 and the upper pedal arm 12 which does not move relative the mounting bracket 22 during adjustment of the pedal 16. It is noted that the pedal 16 does not rotate as the lower pedal arm 14 moves so that the orientation of the pedal 16 does not change. As the position of the pedal 16 is adjusted by rotating the drive screw 76, the upper pedal arm 12 remains in fixed position relative to the mounting bracket 22. It can be seen from the above description that activation of the motor 80 changes the position of the lower pedal arm 14 relative to the upper pedal arm 12 but not the position of the upper pedal arm 12 relative to the mounting bracket 22 and therefore does not affect the connection of the upper pedal arm 12 to the control device of the motor vehicle through the pin 32. While the illustrated slot 30 is substantially linear and horizontal but it is noted that the slot 30 can alternatively be arcuate and/or inclined as necessary to optimize the package size of the control pedal 100 as discussed hereinabove.

Figure 13:
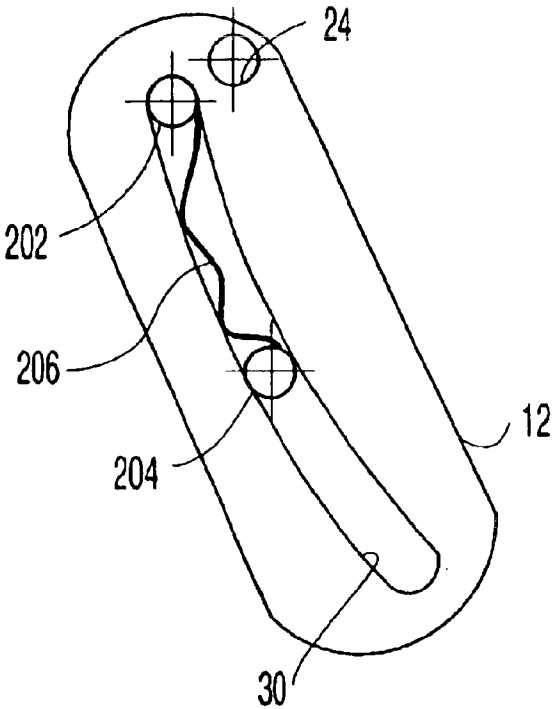
FIG. 13 is a fragmented, enlarged side elevational view of a portion of the control pedal of FIG. 12 with components removed for clarity.
Figure 12:
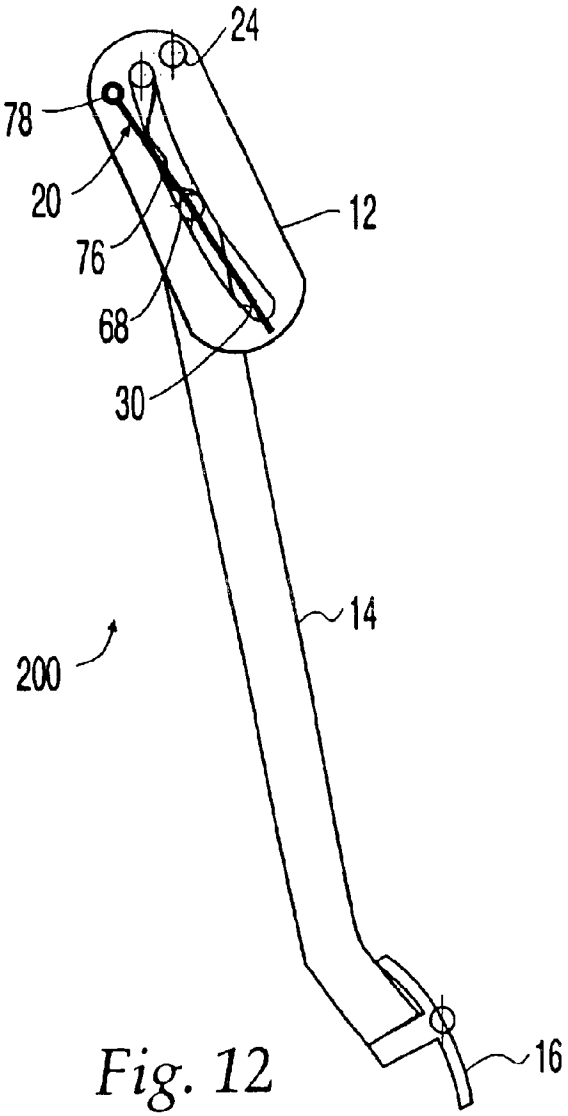
FIG. 12 is a side elevational view of a variation of the control pedal of FIGS. 9 and 10 with components removed for clarity.
Figure 14:
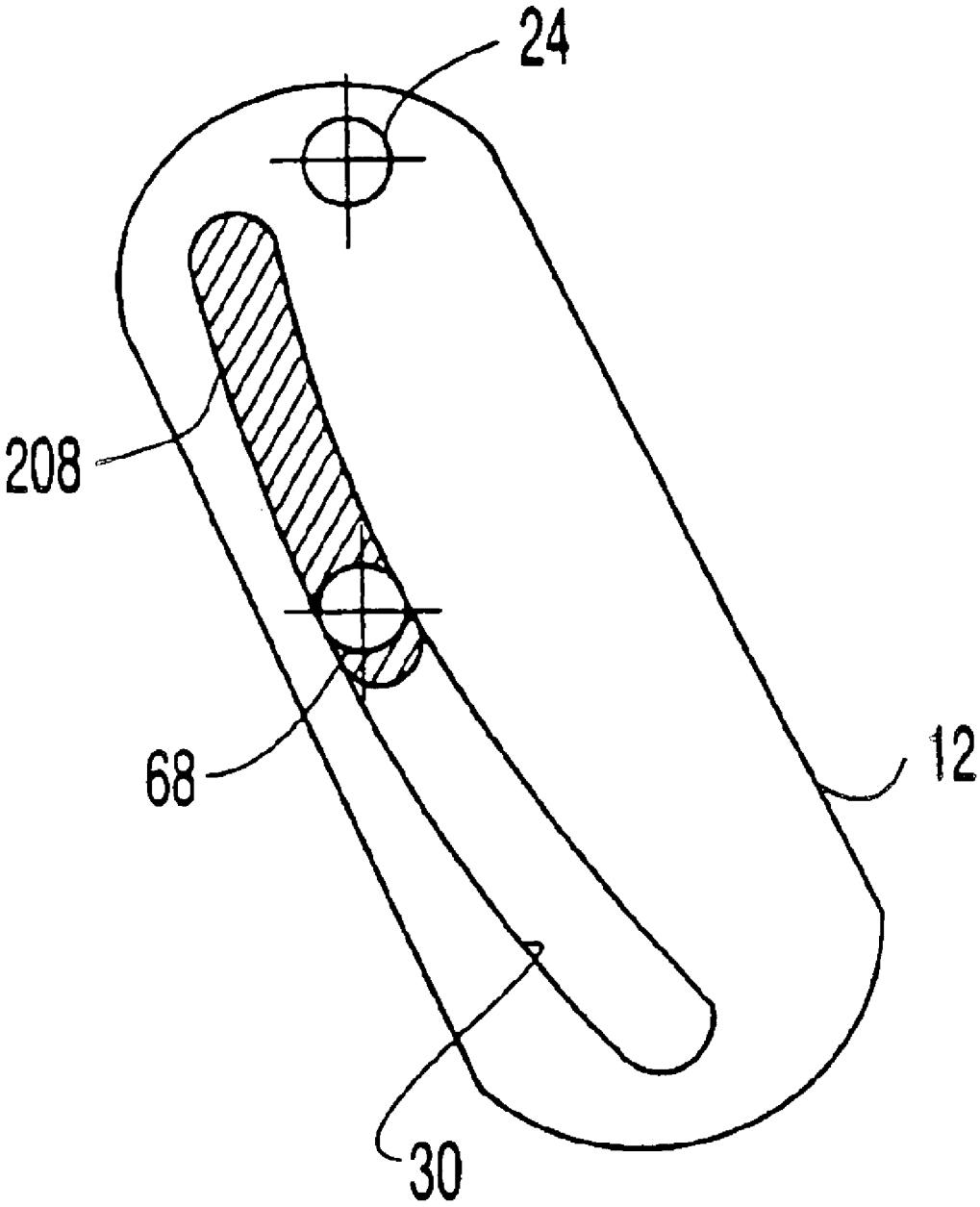
FIG. 14 is side elevational view similar to FIG. 13 but showing another variation of the second embodiment.

FIGS. 12 to 14 illustrate a control pedal assembly 200 for a motor vehicle according to a variation of the second embodiment of the present invention wherein like reference numbers are used for like structure. The control pedal is substantially similar to the second embodiment described hereinabove with reference to FIGS. 9 to 11, except that the slot 30 is arcuate and inclined and the drive block 102 is replaced by a pair of spaced apart pins 202, 204 laterally extending into the slot 30. The forward or upper pin is connected to the upper end of the lower pedal arm 14. The rearward or lower pin 204 is connected to the drive nut 68 and an intermediate position of the lower pedal arm 14. A spring member 206 such as, for example, the illustrated leaf spring is provided to reduce lash. Alternatively, the pins 202, 204 can be provided with bushings and spring washers as described hereinabove. FIG. 14 illustrates that the spaced apart pins 202, 204 can be replaced by an arcuate drive block 208. It is noted that the spaced apart pins 202, 204 are preferable to the drive block 208 because they are easier and less expensive to manufacture and control lash and lost travel to a greater extent.

It should be appreciated that each of the features of the various embodiments can be utilized separately or in combination with each of the features of the other embodiments. For example, the first embodiment can be provided with a horizontal slot, spaced apart pins in the slot, and/or a block in the slot like the second embodiment and the variation of the second embodiment, the second embodiment can be provided with an inclined slot and/or spaced apart pins like the first embodiment and the variation of the second embodiment respectively, and the variation of the second embodiment can be provided with a horizontal slot and/or bushings and spring washer like the first embodiment and the second embodiment respectively.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the upper and lower pedal arms, the link and the slot can have many different forms. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An adjustable control pedal comprising, in combination:

a pivotable upper arm having a slot formed therein;

a lower arm having a lower end carrying a pedal and operatively connected to the upper arm for selected movement relative to the upper arm;

a drive assembly operatively connected to the lower arm to selectively move the lower arm relative to the upper arm;

a guide block secured to the lower arm and laterally extending into the slot;

wherein the guide block moves along the slot upon selected movement of the lower arm relative to the upper arm by the drive assembly;

wherein the slot is arcuate and the guide block has arcuate upper and lower surfaces engaging edges of the slot;

wherein one of the upper and lower surfaces of the guide block is concave and the other of the upper and lower surfaces of the guide block is convex; and wherein the guide block is formed separate from the lower arm and is attached to the lower arm.

2. The adjustable control pedal according to claim 1, wherein the drive assembly includes a screw carried by the upper arm, a nut threadably engaging the screw and adapted to move axially along the screw upon rotation of the screw, and a motor operatively connected to the screw to selectively rotate the screw, and wherein the nut is secured to the lower arm.

3. The adjustable control pedal according to claim 2, wherein the nut is secured to the guide block.

4. The adjustable control pedal according to claim 1, wherein the guide block has at least one pin extending into an opening of the lower arm to rigidly attach the guide block to the lower arm.

5. The adjustable control pedal according to claim 1, wherein the lower arm is supported by the upper arm only through the guide block.

6. The adjustable control pedal according to claim 4, wherein the guide block has only one pin extending into an opening of the lower arm to rigidly attach the guide block to the lower arm.

7. The adjustable control pedal according to claim 6, wherein the drive assembly includes a screw carried by the upper arm, a nut threadably engaging the screw and adapted to move axially along the screw upon rotation of the screw, and a motor operatively connected to the screw to selectively rotate the screw, and wherein the nut is carried by the pin extending into the lower arm.

8. The adjustable control pedal according to claim 4, wherein the drive assembly includes a screw carried by the upper arm, a nut threadably engaging the screw and adapted to move axially along the screw upon rotation of the screw, and a motor operatively connected to the screw to selectively rotate the screw, and wherein the nut is carried by the at least one pin extending into the lower arm.

9. The adjustable control pedal according to claim 1, wherein one of the upper surface of the guide block is concave and lower surface of the guide block is convex.

10. The adjustable control pedal according to claim 9, wherein the upper and lower surfaces of the guide block are sized and shaped to cooperate with the edges of the slot so that surface contact therebetween is sufficient to stabilize the lower arm during movement relative to the upper arm.

11. The adjustable control pedal according to claim 10, wherein the lower arm is supported by the upper arm only through the guide block.

12. The adjustable control pedal according to claim 1, wherein the upper and lower surfaces of the guide block are sized and shaped to cooperate with the edges of the slot so that surface contact therebetween is sufficient to stabilize the lower arm during movement relative to the upper arm.

13. The adjustable control pedal according to claim 12, wherein the lower arm is supported by the upper arm only through the guide block.

* * * * *